US007040941B2

(12) United States Patent
Schueller

(10) Patent No.: US 7,040,941 B2
(45) Date of Patent: May 9, 2006

(54) VESSEL PROPULSION SYSTEM

(75) Inventor: Thomas Schueller, Koblenz (DE)

(73) Assignee: Schmitt Kugelantriebe GmbH, Andernach (DE)

( * ) Notice: Subject to any disclaimer, the term of this patent is extended or adjusted under 35 U.S.C. 154(b) by 0 days.

(21) Appl. No.: 10/632,153

(22) Filed: Aug. 1, 2003

(65) Prior Publication Data

US 2006/0046587 A1 Mar. 2, 2006

Related U.S. Application Data

(63) Continuation-in-part of application No. PCT/EP02/00562, filed on Jan. 21, 2002.

(30) Foreign Application Priority Data

Feb. 2, 2001 (DE) ..... 101 04 680

(51) Int. Cl.
*B63H 1/04* (2006.01)

(52) U.S. Cl. ..... 440/90

(58) Field of Classification Search ..... 440/90
See application file for complete search history.

(56) References Cited

U.S. PATENT DOCUMENTS

| | | | | |
|---|---|---|---|---|
| 100,820 A | | 3/1870 | Tucker | |
| 175,405 A | | 3/1876 | Bardwell | |
| 1,701,925 A | * | 2/1929 | Kisevalter | 114/291 |
| 3,166,039 A | | 1/1965 | Weymouth | |
| 3,628,493 A | * | 12/1971 | Headrick | 440/12.7 |
| 3,884,176 A | | 5/1975 | Riddle | |
| 4,004,544 A | | 1/1977 | Moore | |
| 4,846,091 A | | 7/1989 | Ives | |
| 5,013,269 A | | 5/1991 | Legoy et al. | |

FOREIGN PATENT DOCUMENTS

| | | |
|---|---|---|
| FR | 755483 A | 11/1933 |
| GB | 251869 A | 5/1926 |
| WO | WO 99/29568 | 6/1999 |

* cited by examiner

*Primary Examiner*—Jesus D. Sotelo
(74) *Attorney, Agent, or Firm*—Lawrence E. Laubscher, Sr.; Lawrence E. Laubscher, Jr.

(57) ABSTRACT

The present invention relates to a vessel propulsion system and, more specifically, to a vessel propulsion system with improved efficiency and which leads to reduced wave formation, which comprises a propulsion device immersed at least partially in water and which rotates about at least one axis of rotation essentially extending perpendicularly to the propulsion device, as well as a cover partially enclosing the propulsion device, whereby the cover and the propulsion device together form a water conveying flow channel when the propulsion device is operated.

43 Claims, 10 Drawing Sheets

VESSEL PROPULSION SYSTEM

CROSS-REFERENCE TO RELATED APPLICATIONS

This application is a continuation-in-part of the International Application No. PCT/EP02/00562 filed Jan. 21, 2002, based on the German priority Application No. 101.04680.4 filed Feb. 2, 2001, and includes the new subject matter contained in the German application No. filed Jul. 29, 2003.

BACKGROUND OF THE INVENTION

Field of the Invention

The present invention is in the field of propulsion of watercraft and relates to a vessel propulsion system.

As in all technical fields, also the shipbuilding industry is making an effort to raise the efficiency of a vessel's propulsion system. In addition, especially for inland navigation, there is an increasing need to provide fast vessels that create the smallest possible waves at high speed. It has been demonstrated that waves beating against the shore banks not only impair the reinforcements along them, but also harm the biotopes located at the shore, and in particular disturb the hatching behaviour of birds in habitats nearby.

In addition, especially inland navigation faces the problem of having to avoid pollution caused by lubricants necessarily used for rotating parts of a vessel propulsion system, whereby such lubricants can be released into the water if these parts lie below the water surface during operation of the vessel propulsion system. Almost all known motor or engine driven vessel propulsion systems face this problem.

SUMMARY OF THE INVENTION

The object of this invention is to provide an efficient vessel propulsion system that also takes the above problems into account.

This object is solved by a vessel propulsion system according to a first aspect of the present invention exhibiting a propulsion device immersed at least partially in water, which rotates about at least one axis of rotation essentially extending perpendicularly to the direction of propulsion, and which also includes a cover partly enclosing the propulsion device, whereby such cover and the propulsion device together form a water conveying flow channel when the propulsion device is operated.

The vessel propulsion system according to the invention has a propulsion device, for example a rotatably driven wheel or a driven revolving belt. This rotating or revolving propulsion device is enclosed at its outer circumferential surface by a cover which, however, does not enclose the entire circumference of the propulsion device. On the contrary, the propulsion device comes directly into contact with the surrounding water below the waterline of the vessel to be driven. With the vessel propulsion system according to the invention, the distance between the cover and the propulsion device is chosen such that, when the propulsion device is operated, the water surrounding the vessel is conveyed by the propulsion device into the gap between the front end of the propulsion device and the cover and the air therein is forced out of the gap. This applies at least, as described below in more detail, in the case to be considered as a preferred embodiment, where the cover extends below the waterline independent of the loading condition of the vessel and the upper edge of the cover is arranged above the waterline also independent of the loading condition of the vessel—in other words, where also air is at least present between the circumferential surface of the propulsion device and the cover before the propulsion device is operated.

When the propulsion device is operated, the water conveyed by the propulsion device into the gap between the front end of the propulsion device and the cover is conveyed along with the propulsion device in the direction of rotation. Operating the propulsion device thereby results in the formation of a flow channel in the gap, in which the water is being conveyed in the rotating direction of the propulsion device.

The efficiency of the device according to the invention was evaluated in a bollard pull test by its inventor. For such a test, either the vessel or a model thereof is fixed to a bollard, with a load cell mounted in-line, to determine the traction force per unit of power. With conventional propellers commonly also referred to as marine screws, a power output of about 0.023 kg/W can be determined in a bollard pull test of this type. In comparison, the vessel propulsion system according to the invention generated a maximum output of 0.054 kg/W. This maximum output was reached with the vessel propulsion system according to the invention when the flow channel was full of water. Accordingly, the vessel propulsion system according to the invention offers an essentially higher degree of efficiency compared to the known vessel propulsion systems.

Practical experiments have in addition shown that at the same driving performance, i.e. the same speed of the vessel model, the vessel propulsion system according to the invention generated a markedly smaller stern wave than that generated by a conventional propeller drive, which specifically takes the requirement for reduced wave formation, particularly for inland navigation, into account. However, the vessel propulsion system according to the invention can be applied effectively not just for vessels for inland navigation.

Although with the vessel propulsion system according to the invention, for example, a propulsion device revolving in a belt-shaped manner may be provided, which may revolve either on a circular track or in the manner of a tank chain with two opposingly situated linear sections and two opposingly situated semicircular sections, whereby such propulsion device is arranged both outside and inside, at a distance to a casing wall, in a water bearing channel, for simplification of the construction of the vessel propulsion system it is proposed to form the propulsion device with a circumferentially closed circumferential surface. In this case, water circulating in the propulsion direction is, in the radial direction of the propulsion device, exclusively present between the outer circumferential surface of the propulsion device and the cover.

The build-up of a flow channel as fast as possible, that conveys water in the direction opposite to that of the direction of propulsion after starting the propulsion device, is achieved in that the flow channel is narrowly limited laterally. The propulsion device may have appropriate contours on its circumferential surface for this purpose. However, according to a preferred further development and to simplify the constructive embodiment of the vessel propulsion system, it is proposed that the circumferential surface of the propulsion device is bordered laterally with bounding elements extending beyond the circumferential surface and almost up to the cover. These bounding elements can be arranged, according to a preferred further development of the present invention, either stationarily like the cover, for instance directly on the vessel hull, or at least stationarily relative to the vessel hull. Alternatively it is proposed to connect the bounding elements to the rotating propulsion device.

In order to fill the flow channel on starting up the propulsion device, and also from the viewpoint of efficiency, it has been found advantageous to arrange several teeth one behind the other on the outer circumferential surface of the propulsion device.

These teeth should be formed such that they help to transport the water from the surroundings into the gap between the front end of the propulsion device and the cover. The efficiency of the vessel propulsion system with different directions of rotation can be influenced by the teeth geometry. For example, if the vessel propulsion system according to the invention is used in a vessel as a cross-drive for manoeuvring, and if it is therefore important to achieve the same efficiency in both directions of rotation of the propulsion device, preferably teeth with identically formed leading and trailing edges are arranged on the circumferential surface of the propulsion device.

With a vessel propulsion system with a preferential rotation direction as propulsion direction the teeth formed on the outer circumferential surface of the propulsion device are preferably formed similar to saw teeth, i.e. the leading and trailing edges of the teeth have different inclinations. It has been found advantageous for the leading edge directed radially outwards to the tooth tip to have a smaller inclination than that of the trailing edge adjoining such leading edge on the rear side of the tooth tip and from there directed radially inwards. The trailing edge can even have a sharply radial gradient inwards, i.e. it does not contribute to the circumferential surface. The situation is, however, different for the leading edge. By its ramp-shaped gradient, particularly with a rotating direction of propulsion, the surrounding water is to be pressed into the gap between the cover and the circumferential surface of the propulsion device. When the propulsion device is started, such a ramp-shaped inclination of the leading edge accordingly results in a relatively rapid formation of the flow in the flow channel.

Practical experiments have further shown that it is advantageous to form the tips of the teeth with an arcuate profile in the axial direction, as proposed in a preferred further development of the present invention.

Additionally, it has also been found advantageous to form the leading edge and/or the trailing edge of the teeth with an arcuate profile in the axial direction. Moreover, it is preferred to form the leading and/or trailing edges of the teeth with an arcuate convex profile in the circumferential direction, whereby a combination of the two preferred measures mentioned above, i.e. a spherical embodiment of the leading and/or trailing edges, is viewed as advantageous with respect to the efficiency of the vessel propulsion system and also for the avoidance of waves.

As described above, with regard to the starting behaviour of usual motors for vessel propulsion systems, it is preferable to arrange the upper edge of the cover above the vessel waterline and to allow the front and/or rear ends of the cover to extend below the waterline. With such an embodiment, and if the vessel propulsion system is not in operation, air also exists in the gap between the propulsion device and the cover, which is initially forced out by the ingress of water into the gap when the propulsion device is started. As long as there is air in the flow channel, however, the resistance of the propulsion device to rotation is relatively low. This suits the low starting torque of the usual motors in vessel propulsion systems.

With respect to efficiency, it has been found advantageous for the amount of water drawn into the gap between the propulsion device and the cover to be drawn into the gap and removed out of it at a relatively high ratio of horizontal velocity. On the other hand, it should be possible for a specific circumferential section around the propulsion device to freely communicate with the surrounding water. It has been found that the preferred enclosure angle of the cover around the propulsion device is between 200° and 270°. Additionally, according to a preferred further development of the invention, it is proposed that the end of the cover that forms the inlet for the flow channel is formed with a curvature directed forwards and/or that the end of the cover that forms the flow channel's outlet has a curvature directed rearwards. For attaining good efficiency, it has been further found advantageous to provide a minimum gap between the propulsion device and the cover of a size of 2% to 10%, preferably 3% to 6%, of the diameter of the rotating propulsion device. The minimum gap in the previously stated sense, with the preferred embodiment mentioned above with teeth the tips of which have a convex curvature in the axial direction, occurs where the distance between the teeth tips and the cover is at a minimum. It should be noted here that the cover for attaining good efficiency can be formed relatively simple, preferably across from the circumferential surface of the propulsion device, preferably evenly in the axial direction. When a wheel is used as the propulsion device, the cover is thus formed cylindrically but open in one circumferential section.

In view of the best possible effective steering of a vessel provided with the vessel propulsion system, it is further preferred to arrange the propulsion device perpendicular to its axis of rotation and supported rotatably about a steering axis, and to also provide a control device to control the rotation of the propulsion device about the steering axis. With such a preferred embodiment, the driving direction can be influenced by rotating the propulsion device about the steering axis without the need for arranging, in addition, a rudder on the vessel. Furthermore, the maximum efficiency of the propulsion device can be utilized in both the reverse and forward driving directions through appropriate rotation of the propulsion device.

To seal the propulsion device appropriately and simply and, if applicable, a driving motor arranged relatively close to the propulsion device, it is preferred to arrange the propulsion device together with the cover on a support plate through which the propulsion device protrudes, which plate in turn is sealed on top with a hood. The hood, accordingly, encloses at least the propulsion device, but not necessarily a possible motor and lubricated bearings or such. When the vessel propulsion system is operated, occasionally there is water within the hood and in the propulsion device area. Here, however, there are no parts lubricated with lubricant so that no lubricant can be released into the surrounding water from within the hood.

In this preferred further development, the support plate is accommodated in a pan that is rotatably supported in the vessel hull and open on the bottom, and the propulsion device protrudes through it, whereby a seal is provided between the support plate and the pan. This seal can, for example, be formed by a bellows. In this embodiment, the surrounding water comes merely to the underside of the pan, the underside of the cover plate and into the area sealed by the hood. Lubricant contamination of the water through contact with lubricated components can thus be avoided, for example, by making all the bearing components of a drive shaft or axis of rotation watertight by the hood.

The aforementioned preferred embodiment is accordingly further developed preferably in that the hood forms the cover. In this case, the section of the hood radially surrounding the propulsion device serves simultaneously as the cover to limit the gap around the circumference of the propulsion device.

To compensate for the gyroscopic forces generated when the propulsion device rotates under full power, it is further preferred to arrange the support plate with a pivoting means on the pan such that at least one inclination attenuator is connected in-line. The gyroscopic forces that develop when the propulsion device is pivoted about the steering axis can thereby be counteracted through certain pivoting of the support plate against the resistance of the inclination attenuator, thereby preventing these forces from being directly transferred on to the vessel hull.

The behaviour of the vessel propulsion system according to the invention can be controlled, according to a preferred further development, in that a gap setting mechanism is provided for adjustment of the distance between the propulsion device and the cover. With this gap setting mechanism, the height of the flow channel can be altered in the vessel propulsion system according to the invention, for example in order to influence the quantity of water flowing around in the flow channel at a constant motor speed (operating point of the driving motor). Therefore, the formation of waves at the vessel stern can be changed without having to change the operating point of the driving motor.

To adapt the vessel propulsion system to different navigation channel depths, especially for inland navigation, according to a preferred further development of the invention it is proposed to include an immersion depth adjustment device for height adjustment of both the propulsion device and cover. By such an adjustment device the depth to which the propulsion device is immersed in the surrounding water can be influenced without simultaneously altering the gap that forms the flow channel. An immersion depth adjustment device of this type is especially preferred if the propulsion device protrudes beyond the bottom of the vessel hull. In particular, with propulsion devices for vessels navigating in very shallow waters or vessels that run aground with the tides, whose propulsion means, due to this, should nevertheless not be damaged, it is quite conceivable to form the propulsion device such that the axis of rotation extends in the vertical direction, i.e. the propulsion device protrudes through the side of the vessel.

With the usual arrangement of the propulsion device on the underside of the vessel hull, in view of the best possible buoyancy of the vessel, especially for fast driving full glider boats, it is preferable to provide on the front ends of the propulsion device in each case at least one float tapering down from the propulsion device preferably in the axial direction of the axis of rotation. A float tapered in such a way is preferably attached directly to the front end of the propulsion device and has a diameter in this area equal approximately to that of the propulsion device. For reasons of flow dynamics, the diameter tapers in the axial direction of the axis of rotation, whereby the float is formed preferably conical in shape, with an outer surface initially convex in curvature adjoining the propulsion device and followed by a straight outer surface or by one which is concave in curvature. A float formed in this way, preferably formed as an enclosed hollow body, results, however, not only in better buoyancy of the vessel, but also, in addition, raises the vessel during its motion and due to the forces counteracting the float. In order to avoid frictional losses between the oncoming water stream and the float, and thus raise efficiency, it is furthermore preferred to arrange the float such that it is freely rotatable on the axis of rotation or on the drive shaft of the propulsion device.

It has been found advantageous particularly with fast driving full glider boats to provide a thickening on the radial outer end of the propulsion device. This thickening, which is connected to the propulsion device and covers the propulsion device in a mushroom-head-like manner, protrudes beyond the circumference of the float at least partially. It has been found that, due to the high efficiency of the vessel propulsion system according to the invention, vessels formed as glider boats and supported by the buoyancy effect of the floats can rise far enough out of the water at full power that they essentially stay in contact with the water merely through the mushroom-head shaped thickenings. Preferably, the vessel propulsion systems according to the invention are for this purpose provided such that two propulsion systems in each case are arranged at the vessel's front end and two at its rear. In this case, the in total four propulsion devices simultaneously form the propulsive parts at full power as well as those parts which, for example, with a hydroplane, carry the vessel's load on the water. In this regard it is preferred to form the mushroom-head shaped thickening as hydrodynamic as possible such that its outer circumferential surface preferably forms the continuous continuation of the outer circumferential surface of the float.

For the solution of the above object and according to a second aspect of this invention, the generic vessel propulsion system is further developed such that the leading and trailing faces of each of the teeth formed on the propulsion wheel exhibit a spherical, convex surface, that the tip of each tooth is curved convex in the axial direction and that the starting point of the radii of curvature of the spherical surfaces and of the contour of the tooth tip are located in a plane extending orthogonally to the rotational axis of the toothed wheel, the said plane also including the centre point of the propulsion wheel in the axial direction. It has been surprisingly found that this type of formed surface of the propulsion device leads to quite high levels of efficiency. For example, it has been shown during a bollard pull test that a pulling force of 42 kg/kW of engine power is achieved with the vessel propulsion system according to the invention, whereas the corresponding figure for a normal propeller is between 13 and 15 kg/kW.

The relatively high efficiency figures of the vessel propulsion system according to the invention are due to the special design of the teeth formed on the external circumference of the propulsion wheel. With these teeth, the leading and trailing faces are formed spherically convex in the circumferential direction. The leading face is taken to be that face of the tooth forming the front tooth face with rotation of the propulsion wheel in the main propulsion direction, whereas the trailing face is the rear face of the corresponding tooth with rotation in the main propulsion direction.

The propulsion wheel formed according to the second aspect of this invention is further characterised compared to the state of the art in that the tooth tip of each tooth is curved convexly in the axial direction. Finally, the starting points of the radii of curvature of the spherical surfaces of the faces and the contour of the tooth tip are located in a plane extending orthogonally to the rotational axis of the toothed wheel. This plane also includes the centre point of the propulsion wheel in the axial direction, which means that the surfaces of the faces are provided as surfaces of a spherical segment on the external circumferential surface of the propulsion wheel, whereby the point with the highest location in the axial direction of the surface of the spherical segments is situated in each case at the centre of the propulsion wheel. The same requirement is made according to the first aspect of this invention for the contour of the tooth tip. This is also formed symmetrically to the axial centre of the propulsion wheel. The face sides of the propulsion wheel can, for reasons of simple construction, be formed flat. Alternative designs are also possible, such as for example are known from the generic state of the art, the disclosure of which is included in this application through reference.

Preferred further developments of the vessel propulsion system according to the invention and according to the first aspect of this invention are given in the subclaims 2 to 8.

With its third aspect, this invention suggests solutions to the above problem in which the generic vessel propulsion system is further developed in that gusset channels, which are formed between adjacent teeth of the propulsion wheel on its circumferential surface, open axially outwards. The gusset channels, which extend in the axial direction on the circumferential surface of the propulsion wheel and essentially over the tooth base, communicate correspondingly with an intervening space, which is formed between the propulsion wheel and the side surfaces of a housing, which encloses the propulsion wheel and also contains the cover.

It has been found that in particular with those types of vessel propulsion systems which do not have any preferred main direction of propulsion and develop essentially equal thrust in each of the two directions of rotation, the efficiency of the vessel propulsion system can be improved in that during operation of the vessel propulsion system water is passed between the propulsion wheel and the side surfaces of the cover essentially opposite to the force of gravity and is brought into the gusset channels at the side. The corresponding water is, in particular after the forming of a separation-free flow circulating with the drive wheel, passed through the intervening space and to the gap formed between the external circumferential surface of the propulsion wheel and the cover, and namely due to a suction effect which is established only after the formation of a circulating flow. It has been found, compared to the previously known generically regarded solution principle in which side cheeks prevent axial external access to the gusset channels, that this type of design leads to an increased efficiency of the vessel propulsion system.

With regard to a uniform thrust in each of the two directions of rotation, it is also preferable to form the leading and trailing faces essentially the same geometrically and to terminate the inlet and outlet apertures of the gap at approximately the same height.

It has been found to be effective if the volume of the intervening space is matched to the volume of the gap between the external circumferential surface of the propulsion wheel and the cover.

With flat and parallel to one another extending side surfaces of the housing on one side and with the drive wheel on the other side, the volume of the intervening space is calculated from the product of the base area of a truncated circle and the width of the intervening space, i.e. the distance between the side surface of the propulsion wheel on one side and the housing on the other. The truncated circular area has a radius which is given by an addition of the largest outer radius of the propulsion wheel and the smallest height of the gap. With an at least largely constant gap in the circumferential direction, the smallest height of the gap is determined by the distance between the highest point of the tooth tip and the cover. The base area of the truncated circle is determined from a difference of two areas, namely the base area of the circle and a cup-shaped area, one side of which is formed by the outer edge of the circle and the other side of which is formed by a secant, which cuts the circle exactly at the point on its outer side where the enclosure of the propulsion wheel is terminated by the cover. This secant cuts the inlet and outlet apertures, i.e. the corresponding ends of the cover. The volume of the gap can be determined by exact calculation of the gap geometry via the enclosure angle of the cover around the propulsion wheel.

As a simple rule of thumb for the specification of the two-sided volume of the intervening space on one hand and of the gap on the other, a relationship between the width of the propulsion wheel and the width of the intervening space has been established. Here, at least half of the axial extension of the propulsion wheel corresponds to the axial extension of the intervening space.

With regard to the generation of a directed momentum parallel to the direction of travel of the vessel, according to a preferred embodiment of this invention, it is proposed that the cover for the propulsion wheel is provided with a enclosure angle of between 200° and preferably 270°, whereby a region of the cover forming the outlet aperture in the main drive direction of the vessel propulsion system for the flow circulating with the propulsion wheel encloses the propulsion wheel so far that the flow is supplied mainly parallel to the direction of propulsion. Compared with this, a region of the cover forming the inlet of the hydrodynamic drive for the circulating flow in the main direction of propulsion is formed such that the flow is essentially drawn into a gap formed between the cover and the circumferential surface of the propulsion wheel at a speed extending essentially perpendicular to the direction of propulsion. This type of vessel propulsion system, adapted with regard to a high efficiency in the main direction of propulsion, preferably exhibits cheeks which are fitted to the face side of the propulsion wheel and protrude beyond the tooth base to contain at the side the flow forming and circulating in the gap. With this embodiment, the cheeks preferably extend to about the highest point of the tooth tips.

In particular with relatively fast running vessel propulsion systems with a fast running propulsion wheel, it is also preferable if the gap for forming a circulating flow tapers in the region of the outlet opening in the main direction of propulsion, leading to the circulating flow being accelerated on being ejected in the tapered gap and the momentum being increased.

The drawing in of the flow in the surrounding gap is, according to a further preferred embodiment of this invention, promoted in that the gap is widened funnel-shaped in the region of the inlet aperture.

Apart from the tapering outlet aperture and the inlet aperture running funnel-shaped in the direction of flow, the gap is furthermore preferably constant in the circumferential direction over about 90% to 95% of the enclosure angle. It has been found to be particularly effective if the gap is formed, in its section constant in the circumferential direction, with a height corresponding to 0.08 to 0.12, preferably 0.09 to 0.11 of the mean of the three radii of curvature. This gap height is determined from the radial extremity of the tooth tip through to the cover.

BRIEF DESCRIPTION OF THE DRAWINGS

Further details, advantages and characteristics of this invention become apparent from the following description of embodiments in conjunction with the drawing, the figures of which show the following.

DETAILED DESCRIPTION

Figure 1:
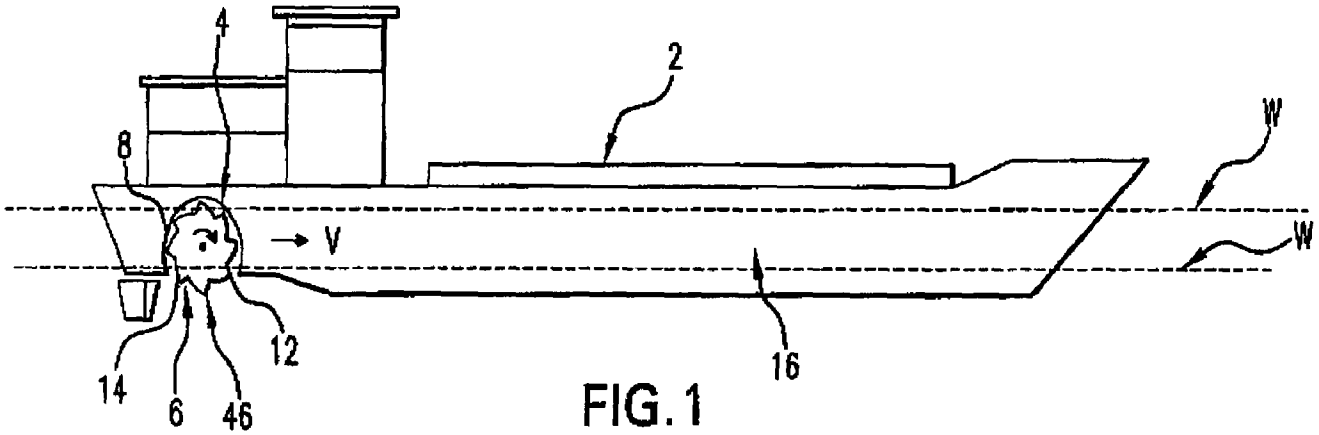
FIG. 1 shows a side view of a vessel with a first embodiment of a vessel propulsion system according to the invention.

FIG. 1 depicts a side view of a vessel 2 formed as displacement vessel for different immersion depths. The different immersion depths are recognizable from the different waterlines W for different loading conditions. At the stern of vessel 2 there is a vessel propulsion system 4 according to the first embodiment of the present invention. As essential components of this vessel propulsion system 4 a propulsion device formed as a toothed wheel 6 as well as a cover 8 circumferentially enclosing the toothed wheel 6 at least partially are provided. The axis of rotation 10 of the toothed wheel 6 extends, in the embodiment shown, in the horizontal direction and otherwise perpendicularly to the direction of propulsion V, i.e. at right angles to the longitudinal axis of the vessel 2.

The cover 8 is formed cylindrically, i.e. with surfaces extending sideways parallel to the axis of rotation 10. The cover 8 encloses the toothed wheel 6 with an enclosure angle of about 240°. The cover 8 has a front end, i.e. bow end, 12, and a rear end, i.e. stern end, 14. Both ends 12, 14 terminate at about the same height and are flush with the underside of the vessel hull 16. Between the two ends 12, 14, the toothed wheel 6 protrudes beyond the underside of the vessel hull 16.

Figure 2:
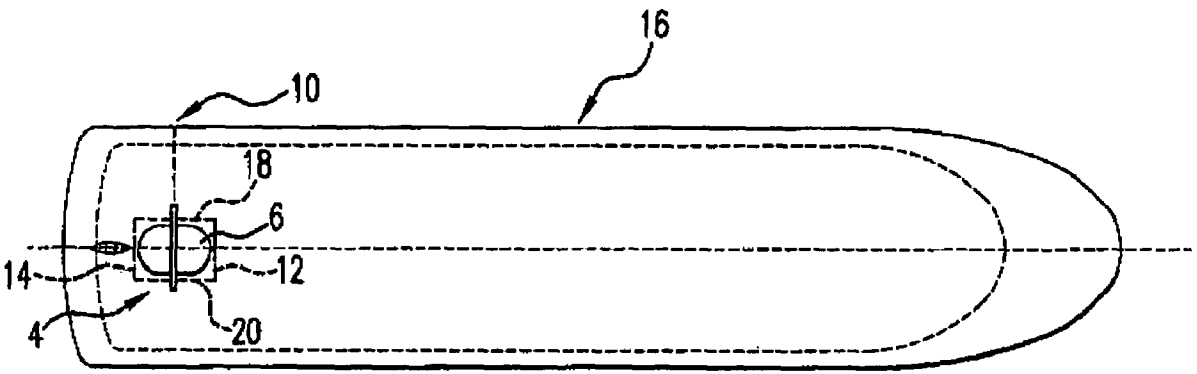
FIG. 2 shows a bottom view of the vessel depicted in FIG. 1.

In the bottom view of the vessel hull 16 according to FIG. 2, the accommodation space for the toothed wheel can be recognized clearly. This accommodation space is circumferentially limited by the cover 8 and laterally formed by stationary sidewalls 18, 20. The sidewalls 18, 20 are connected to the vessel hull 16 and are protruded through by the drive shaft 22 located in the axis of rotation of the toothed wheel, as described in the following in more detail and making reference to FIG. 3.

Figure 3:
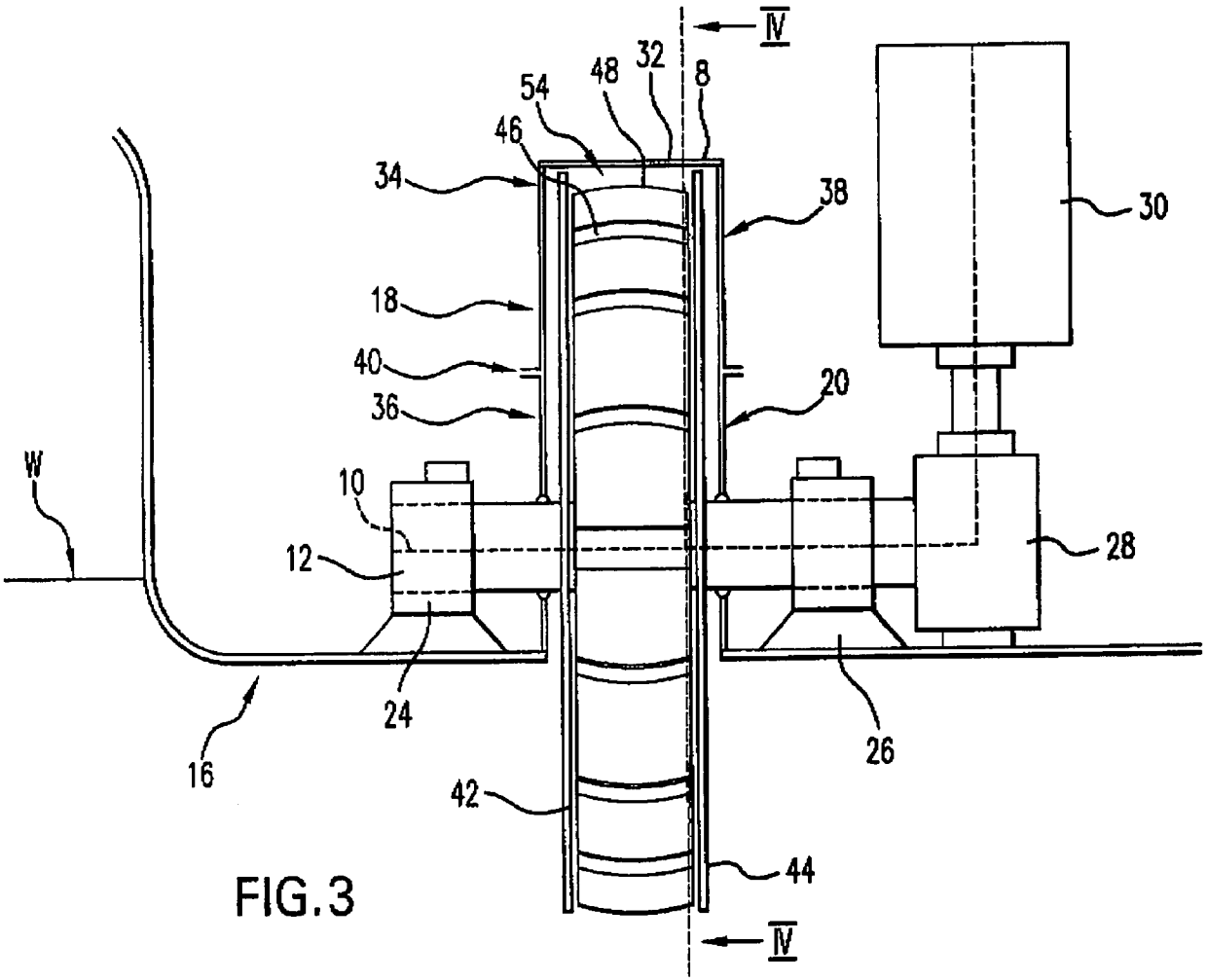
FIG. 3 shows a front view of the embodiment depicted in FIG. 1 with the cover partially cut away.

FIG. 3 shows a front view of the vessel propulsion system as illustrated in FIGS. 1 and 2. The drive shaft 22 is supported on both sides by bearings 24, 26, respectively. At one end of the drive shaft 22, behind the bearing 26, there is an angular gear 28 whose end on the side of the force is connected to any desired type of motor 30, such as an electric motor.

The sidewalls 18, 20 form a U-shaped enclosure around the toothed wheel 6, and their undersides are welded to the vessel hull 16. The drive shaft 22 goes through the sidewalls 18, 20 and is sealed against them with appropriate seals. A horizontally extending cross brace 32, running parallel to the axis of rotation 10 of the drive shaft 22, of the hood 34 formed in this way forms the cover 8 partially enclosing the toothed wheel 6 circumferentially. The hood 34 is formed in two parts, whereby the lower part 36 comprises the seal and the duct for the drive shaft 22 and is firmly connected to the vessel hull, whereas the upper part 38, which is connected to and sealed against the lower part 36 with a flange 40, can be removed for maintenance purposes. The location of the joint between the upper part 36 and the lower part 38 is preferably chosen such as to allow the upper part to be removed under any loading condition without water flowing into the vessel hull 16.

In FIG. 3 it can be recognized that the toothed wheel 6 is laterally bordered by bounding elements 42, 44. These bounding elements 42, 44 are ring-shaped and are firmly connected to the rotating toothed wheel 6. With their radial outer ends the bounding elements 42, 44 extend beyond the circumferential surface of the toothed wheel 6 and almost up to cover 8.

The toothed wheel 6 exhibits several teeth 46 on its circumferential surface that have a convex gradient in the axial direction relative to the axis of rotation 10. In FIG. 3, the tooth tip 48 of the uppermost tooth 46 is clearly recognizable.

Figure 4:
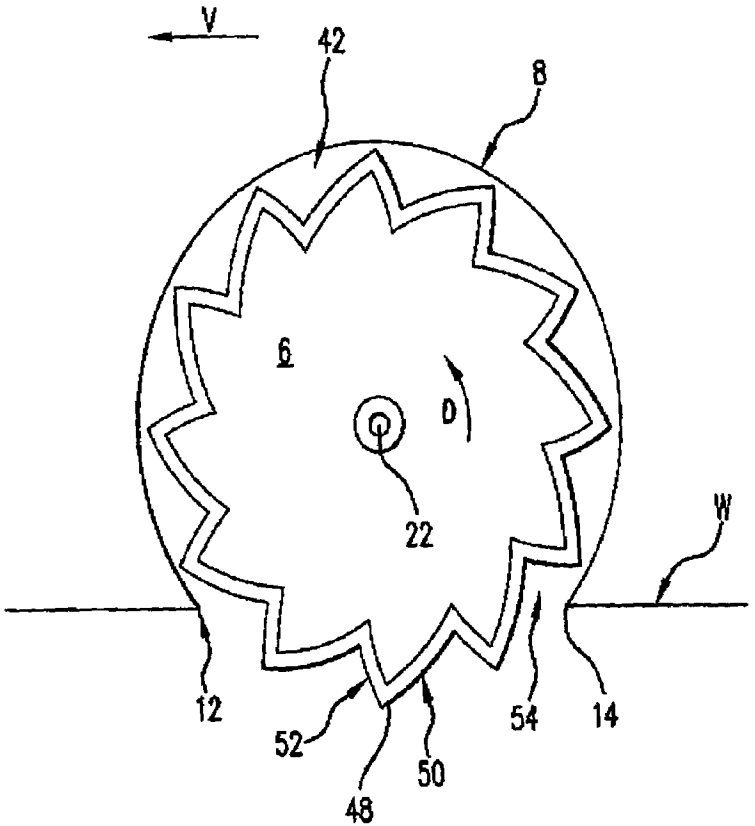
FIG. 4 shows the sectional view IV—IV according to the illustration in FIG. 3.

Details of the circumferential design of the toothed wheel are recognizable from FIG. 4. This shows a sectional view along the line IV—IV according to the illustration in FIG. 3 and particularly serves to highlight the embodiment of the teeth 46. The direction of rotation D in the main direction of propulsion of the vessel, i.e. that particular direction of rotation of the toothed wheel 6 when the vessel moves forward, is marked by a curved arrow D. Each tooth 46 has a leading edge 50 and a trailing edge 52. Relative to the circumference of the toothed wheel 6, the leading edge 50 has a lower pitch than the trailing edge 52. Each tooth 46 of the toothed wheel 6 is identically formed. The leading edges 50 and the trailing edges 52 are convex-shaped relative to the axial extension of the axis of rotation 10. Accordingly, the inner serrated contour in FIG. 4 depicts the outer axial outline of the toothed wheel 6, whereas the outer serrated contour in FIG. 4 reflects the circumferential contour in the middle (relative to the direction of width of the tooth).

Besides the aforementioned convex embodiments in the axial direction, the leading and trailing edges 50, 52, respectively, are also convex-shaped in the circumferential direction. The outcome is that the edges 50, 52 of the respective teeth 46 are formed spherically. The curvature in the axial direction is shown schematically in FIG. 2.

The embodiment shown in FIG. 4 has disc-shaped bounding elements 42, 44 between which sheet metal is welded which forms the leading and trailing edges 50, 52. The leading and trailing edges 50, 52 of the teeth 46 form a circumferentially closed circumferential surface on the toothed wheel 6.

The embodiment shown in FIGS. 1 to 4 is operated as follows: In a non-operative state, i.e. when the toothed wheel 6 is not turning, there is air in the gap 54 above the waterline between the cover 8 and the toothed wheel 6, whereby the shape of the cross-section of this gap changes in the circumferential direction with the pitch of the leading and trailing edges 50, 52. When starting for moving forward (propulsion direction V), the toothed wheel 6 is rotated in the direction of rotation according to arrow D. Initially the toothed wheel 6 turns slowly due to its inertia and carries the surrounding water into the gap 54 by means of the forward leading edge 50 of the respective tooth 46. With an increasing rotation speed of the toothed wheel 6, the air in the gap 54 is fully removed in the rotation direction of the toothed wheel 6. The water flows continuously around in the gap 54 in the rotation direction D. In other words, operation of the toothed wheel 6 results in a water conveying flow channel being formed between the toothed wheel and the cover 8. The current in the flow channel extends from the rear end 14 up to the front end 12 of the channel, i.e. in the direction of propulsion V. The water is conveyed into the gap 54 by the leading edge 50 at a horizontal velocity component which is assumed to be appropriate for moving the vessel forward, and it likewise exits the gap 54 at a horizontal velocity component which is assumed to be appropriate for likewise moving the vessel 2 in the propulsion direction V, i.e. forward.

Figure 5:
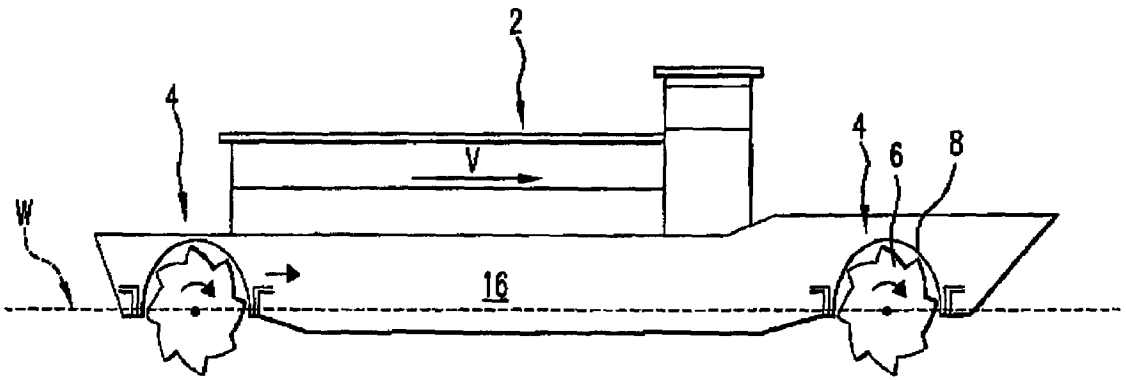
FIG. 5 shows a side view of a vessel with a further embodiment of the vessel propulsion system according to the invention.
Figure 6:
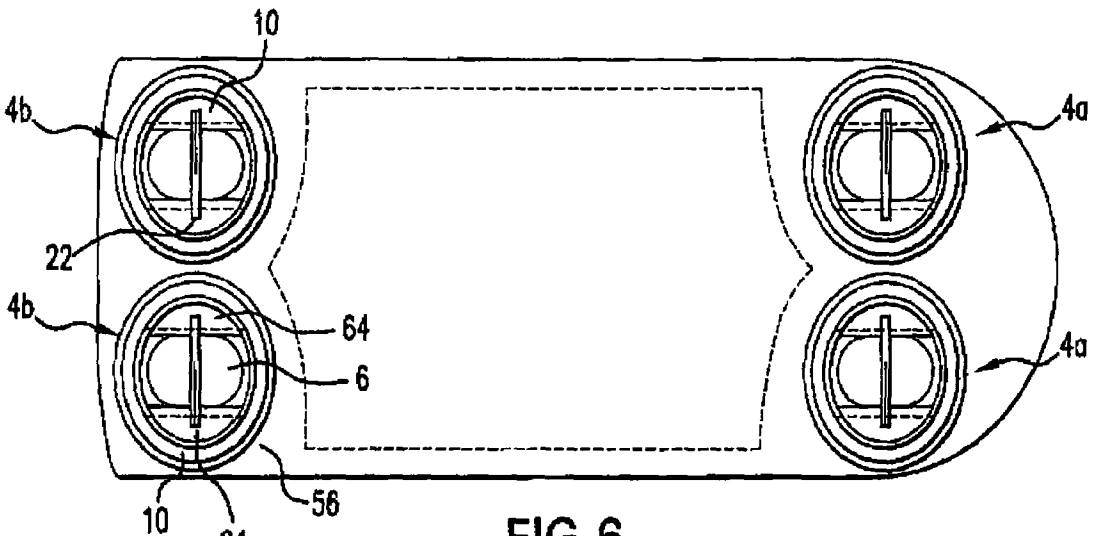
FIG. 6 shows a bottom view of the vessel depicted in FIG. 5.
Figure 7:
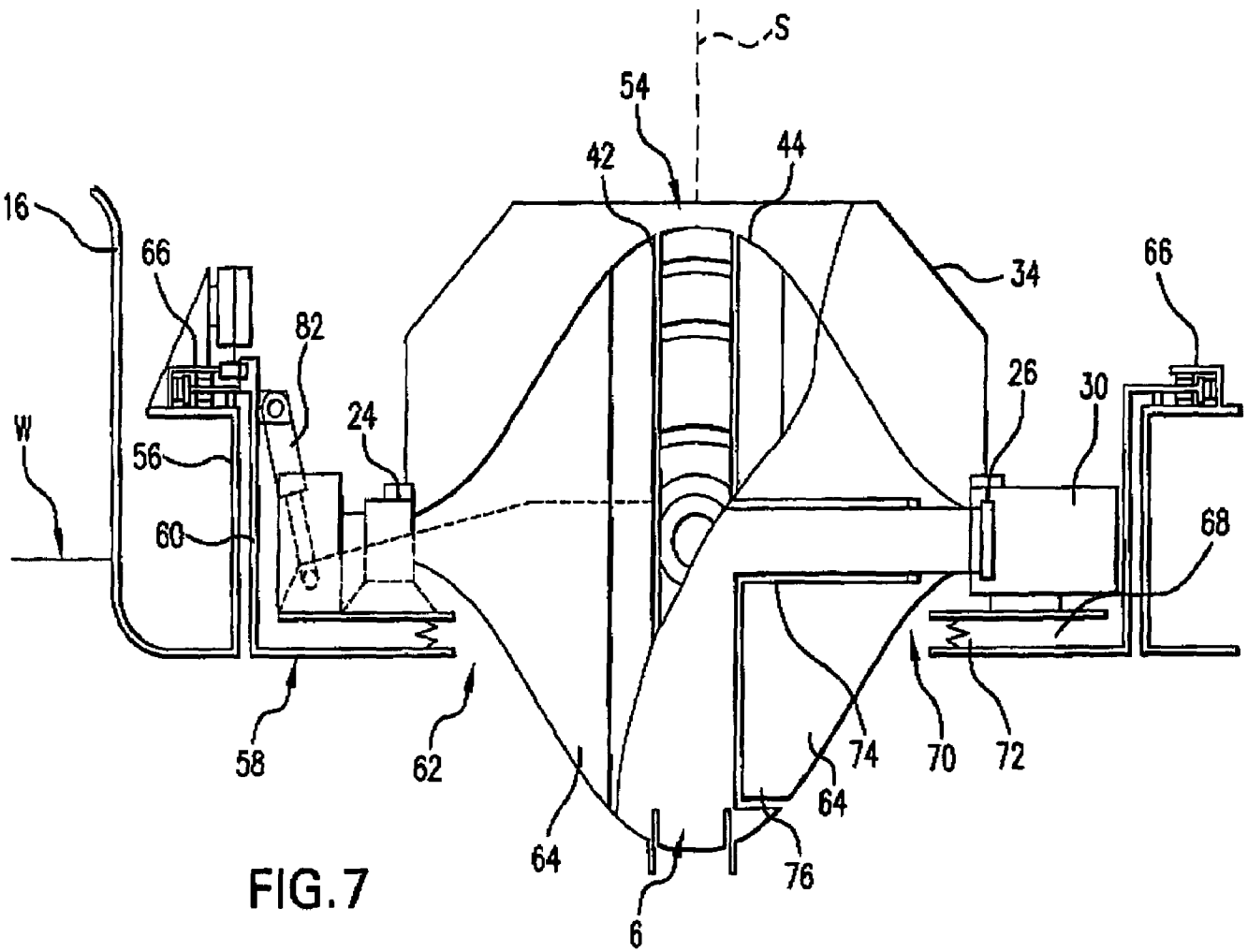
FIG. 7 shows a partial front view of the embodiment of a vessel propulsion system depicted in FIG. 6.

FIGS. 5 to 7 show a second embodiment of the vessel propulsion system according to the invention. As shown in FIGS. 5 and 6, this embodiment is built into a vessel 2 formed as a full glider boat. More precisely stated, four identical embodiments of the vessel propulsion system according to the invention are built into vessel 2. There are in each case two of the vessel propulsion systems 4*a* situated in the direction of width adjacent to each other in the bow of the vessel 2, and two vessel propulsion systems 4*b* are situated in the direction of width adjacent to each other in the stern of the vessel 2. With the vessel illustrated in FIGS. 5 and 6 a separate rudder can be dispensed with, since the vessel propulsion systems are in each case steerable.

Details of this steering arrangement can be seen in FIG. 7. For each vessel propulsion system 4 a circular recess 60 is provided on the underside of the vessel hull 16, each bounded by sidewalls 56 extending above the waterline W. In the cylindrical inner space thus formed there is a pan 58 with its sidewall 60 extending parallel to the sidewall 56 of the hull 16. The underside of the pan 58 has a circular recess 62 through which the toothed wheel 6 and the floats 46 protrude, as described in greater detail below. Through the bearings 66, the pan 58 is, relative to the vessel hull, rotatably supported about an axis of rotation S. This rotation of the pan 58 within the vessel hull 16 is controlled by a control device not shown in detail for steering the respective direction of rotation. Each of the propulsion devices 4*a, b* can be rotated independently of each other about the steering axis S.

The pan 58 accommodates a support plate 68 which also has a circular recess 70 through which the toothed wheel 6 and the floats 64 protrude. The support plate 68 carries the bearings 24, 26 and also the motor 30.

Between the base plate of the pan 58 and immediately adjacent to the recess 62 and the support plate 68 a seal formed as a bellows 72 is provided which surrounds the recesses 62, 70, thereby hindering the ingress of water between the base plate 68 and the underside of the pan 58 into the latter.

The hood 34 rises from the side of the support plate 68 pointing away from the water. Also in this embodiment, the drive shaft 22 protrudes through the hood 34. The bearings 24, 26 are located outside of hood 34.

Also in this embodiment, the toothed wheel 6 is connected to the drive shaft 22 in a torsionally rigid manner, and the bounding elements 42, 44 are likewise provided torsionally rigid to the toothed wheel 6. Located adjacent to the sides of the bounding elements 42, 44 are the respective floats 64 which, through the bearings 74, are supported on the drive shaft 22 in a freely rotatable manner.

The floats 64 are essentially formed identically and have, adjacent to the toothed wheel 6, a diameter which approximately corresponds to that of the latter. The outer contour of the floats 64 is formed as follows in the embodiment shown: A first circumferential section 76 extends parallel to the axis of rotation 10, followed by a second circumferential section 78 which essentially has a plane contour running towards the axis of rotation 10. This second circumferential section 78 can, in view of a buoyancy as great as possible of the floats 64 immersed in water, also be formed in an outwardly convex-shaped manner. The first circumferential section 76 is, on its circumference, surrounded by a thickening 80 firmly connected to the toothed wheel 6. The inside of this thickening 80 is cylindrically formed. The thickening 80 extends on both sides of the toothed wheel 6 and the allocated bounding elements 42, 44 and appears in mushroom-head shape in the sectional view shown in FIG. 7. The thickening 80 is continued centrally in the area of the toothed wheel 6 by the surface contour of the teeth 46. The outer contour of the thickening 80 is continuously and without any steps continued by the tooth tip 48 of the teeth.

The support plate 68 is held in the pan 58 and is supported in a pivoted manner relative to the latter, and more specifically by the in-line arrangement of at least one inclination attenuator 82 formed as a conventional telescopic damper. One end of the attenuator 82 is connected to the upper end of the sidewall 60, whereas its other end is linked close to the support plate 68.

The inclination attenuator 82 serves to dampen pivoting movements about a pivot axis extending, in the embodiment shown, in the longitudinal direction of the vessel. The support plate 68 is supported by bearings at its front and rear ends, seen in the propulsion direction, such that it can be pivoted for these pivoting movements. The pivot axis formed in this way runs, in each case, rectangularly to the axis of rotation of the motor 30 and the steering axis S and intersects the two axes at their common point of intersection. With the embodiment shown, this point of intersection is the centre of the toothed wheel 6.

With respect to the embodiment of the gap 54 between the bounding elements 42, 44, the embodiment shown in FIGS. 5 to 7 corresponds to the previously discussed embodiment of FIGS. 1 to 4. As such, the prior statements on the operation apply accordingly, but it should be noted here that hood 34 covers a larger area including the floats 64.

When the vessel propulsion system shown in FIG. 7 is twisted about the steering axis S, this results, with operation of the vessel propulsion system, in a gyroscopic force due to which the support plate 68 pivots relative to the pan 58. This pivoting motion is dampened by the inclination attenuator 82. Due to this, the support plate 68 is returned to its initial position shown in FIG. 2. The inclination attenuator 82 prevents the gyroscopic force from being transferred directly on to the vessel hull.

Figure 8A:
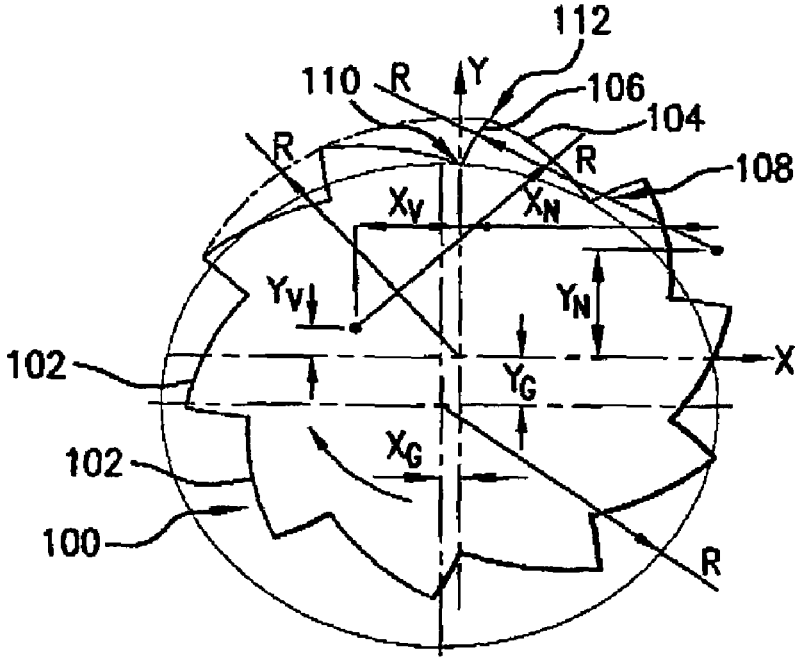
FIGS. 8*a–d* shows sectional views, containing the axial centre point, of various embodiments of propulsion wheels with 10, 12, 15 or 18 teeth.
Figure 8B:
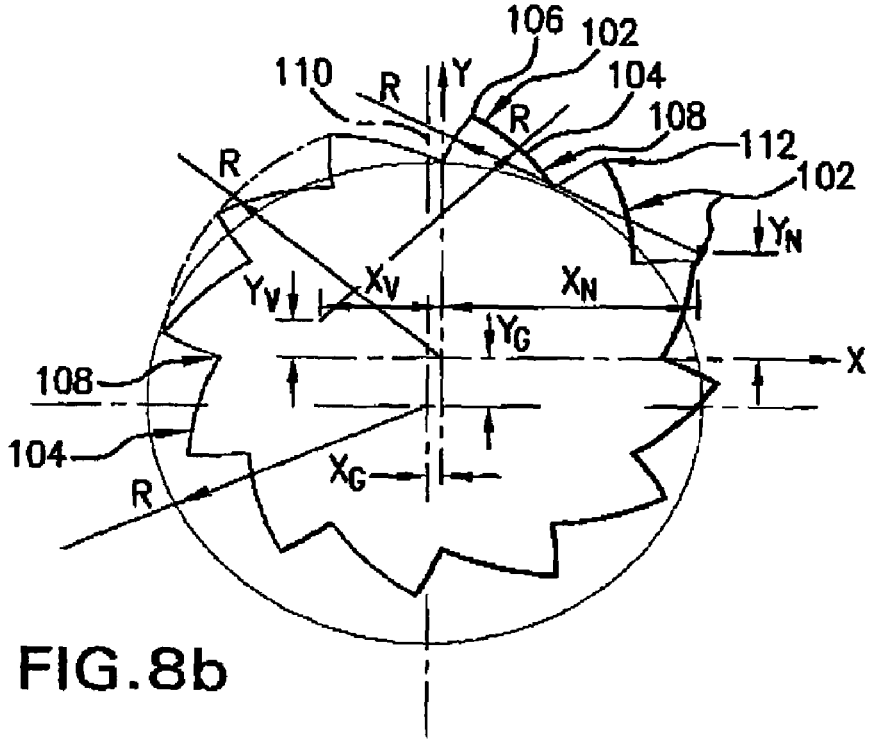
Figure 8C:
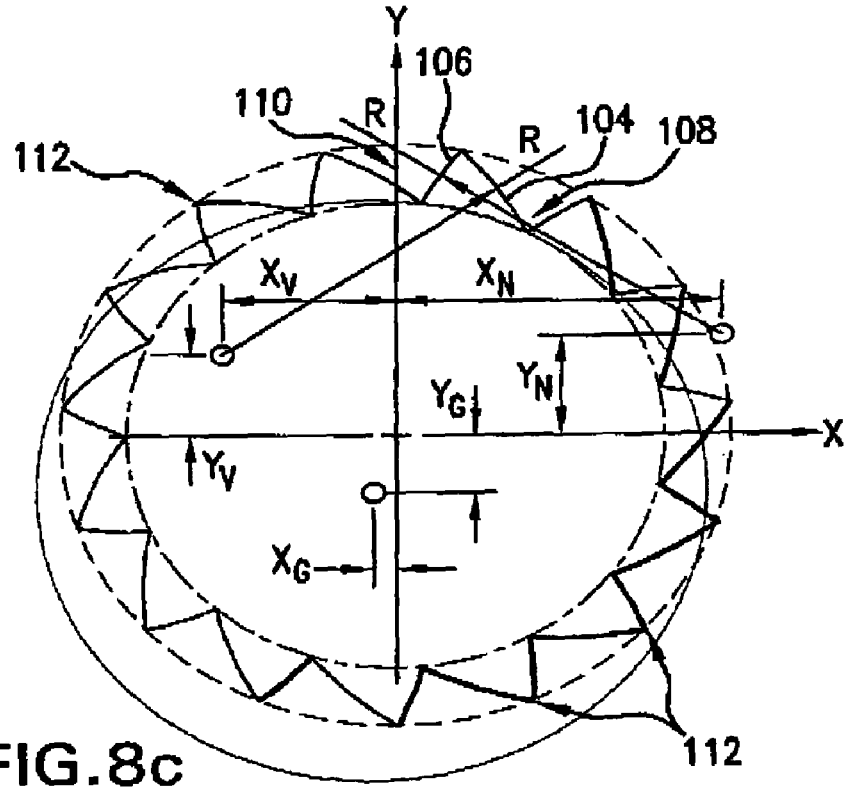
Figure 8D:
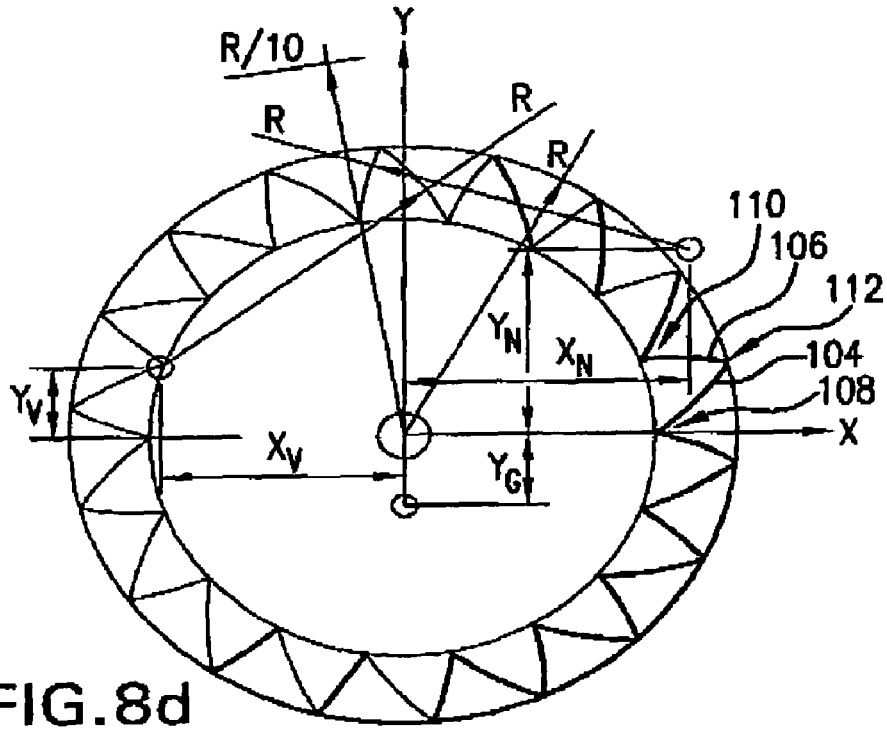

FIGS. 8*a–c* show various embodiments of propulsion wheels 100 of the vessel propulsion system according to the invention with 10 teeth (FIG. 8*a*), 12 teeth (FIG. 8*b*) and 15 teeth (FIG. 8*c*). Each tooth 102 exhibits a leading face 104, a trailing face 106 and in each case a tooth base 108 at the start of the leading face 106 and a further tooth base 110 to the end of the trailing face 106. As can be seen from the sectional illustration of FIGS. 8*a–d*, the leading and trailing faces 104, 106 are in each case curved convexly in the circumferential direction of the propulsion wheel 100. The surface of the complete propulsion wheel 100 is however also curved convexly in the axial direction. This refers both to the curvature in tooth base 108, 110 as well as to the curvature of a tooth tip 112 connecting the leading face 104 and the trailing face 106.

The radii of curvature of tooth base 108, 110, the leading face 104 and the trailing face 106 are in each case identical in the illustrated embodiments. The starting point of the relevant radii of curvature (in each case R=75 mm) of the embodiments shown in FIGS. 8*a–d* is listed in the following table. $Y_G$ gives the distance of the starting point of the radius of curvature for the tooth base from the centre point and rotation point of the propulsion wheel 100. $X_G$ is the corresponding figure for the X axis. The same applies to the leading face ($Y_V$, $X_V$) and to the trailing face ($Y_N$, $X_N$).

TABLE

| | 10 teeth | 12 teeth | 15 teeth | 18 teeth |
|---|---|---|---|---|
| $X_G$ | 4.8 | 4.0 | 4.7 | 0 |
| $Y_G$ | 14.3 | 14.6 | 15.4 | 18.2 |
| $X_V$ | 28.2 | 33.2 | 38.2 | 18.2 |
| $Y_V$ | 8.7 | 11.6 | 20.9 | 54.9 |
| $X_N$ | 70.1 | 70.1 | 73.2 | 69.7 |
| $Y_N$ | 33.3 | 33.3 | 25.8 | 48.7 |

The co-ordinates for the base $X_G$, $Y_G$ apply both to the tooth base 108 and to the tooth base 110. The radius of curvature of the tooth tip in the axial direction is given by the intersection points of the leading and trailing faces 104, 106. The propulsion wheel 100 with 18 teeth has been found to be particularly advantageous.

With the formation of the propulsion wheel 100, which is described in detail with reference to FIGS. 8*a–d*, the starting point of all radii of curvature for the leading faces 104 is located on a circle which is situated concentrically to the axis of rotation of the propulsion wheel 100 and is positioned between a circular area including each tooth base 108 and the axis of rotation of the propulsion wheel 100. The starting point of the radii of curvature of the trailing faces 106, which fall away relatively steeply to the tooth base, is situated at an envelope, which is located outside of the tooth base 108 and is preferably located in a region in which the upper edge of the tooth tip 112 is also located.

Figure 9:
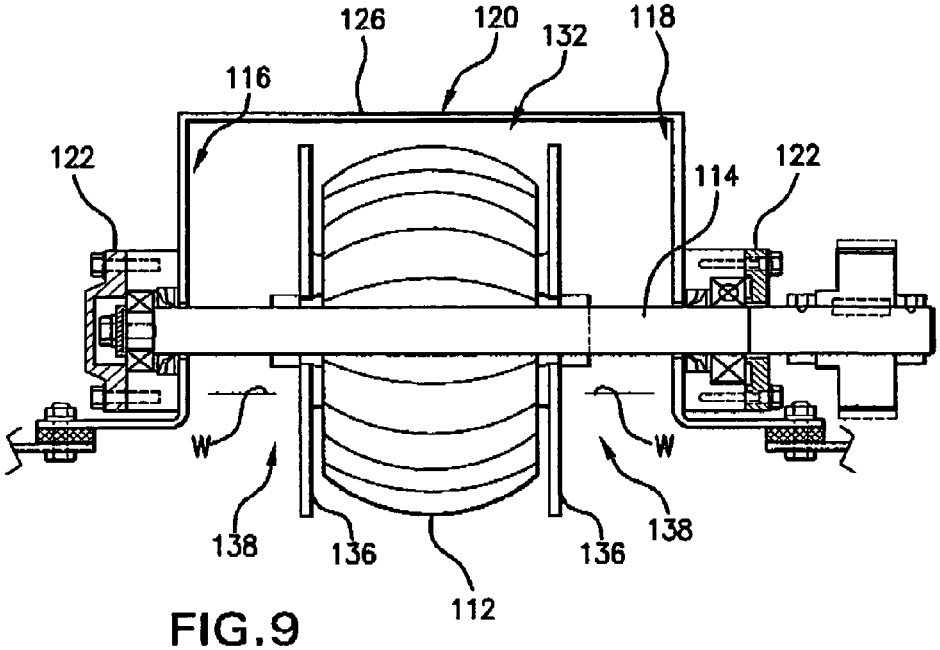
FIG. 9 shows a cross-sectional view of an embodiment of a vessel propulsion system according to the invention.
Figure 10:
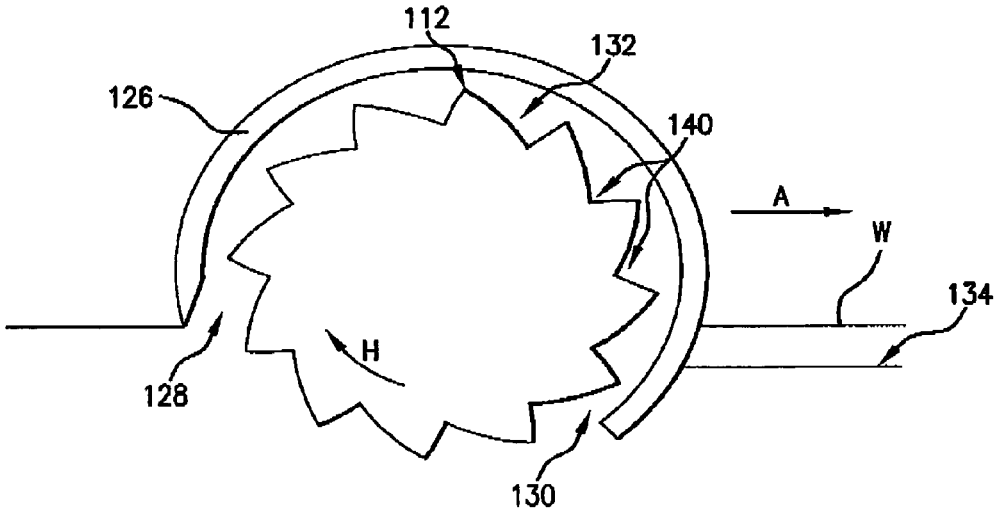
FIG. 10 shows a longitudinal sectional view of the embodiment shown in FIG. 2.

FIGS. 9 and 10 show the embodiment, illustrated in FIG. 8*b*, of a propulsion wheel 100, mounted as part of a vessel propulsion system with a drive shaft 114, which protrudes beyond the side surfaces 116, 118 of a housing 120. Roller bearings 122, 124 for the support of the drive shaft 114 are provided in each case on the outside of the side surfaces 116, 118. These roller bearings 122, 124 are connected to the side surfaces 116, 118.

The housing 120 exhibits a cover 126 which extends parallel to the drive shaft 114. As can be seen, particularly in FIG. 10, the cover 126, at its rear end, i.e. towards the rear end in the main direction of propulsion A, forms a funnel-shaped tapered inlet aperture 128 and a tapered outlet aperture 130. Between the inlet aperture 128 and the outlet aperture 130 the gap 132 remains constant over 90% of its enclosure angle. In the illustrated embodiment the enclosure angle is 2200, whereby the inlet aperture 128 is formed flush with the underside of a vessel's hull 134 and the outlet aperture 130 is formed in a circumferential segment of the cover 126, which protrudes from the underside of the vessel's hull and opens in the direction of the vessel's stern.

With the embodiment illustrated in FIGS. 9 and 10 cheeks 136 are provided in each case on the side surfaces of the propulsion wheel 100, said cheeks protruding beyond the tooth tip 112 on the outer edge of the propulsion wheel 100 and extending to approximately the highest point of the tooth tips 112.

Figure 11:
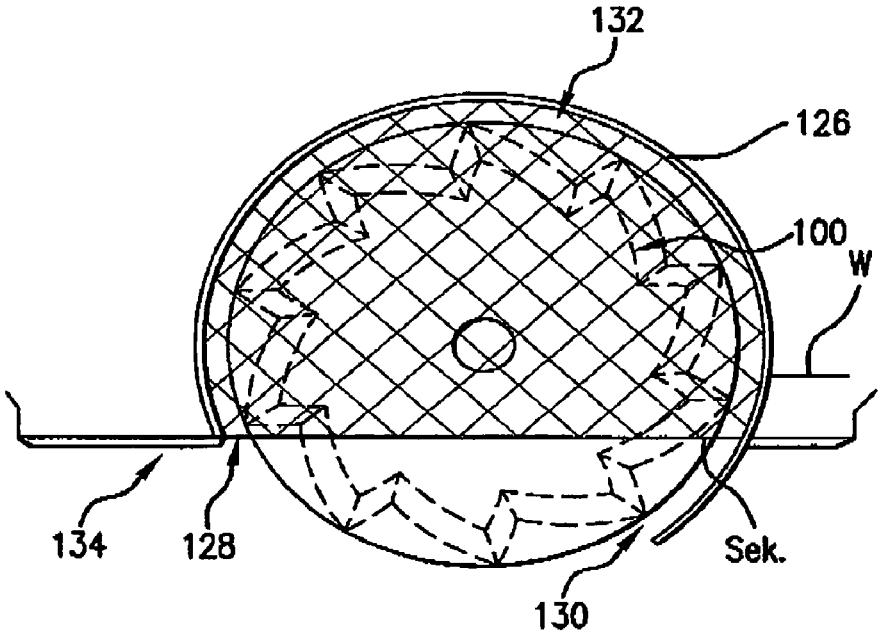
FIG. 11 shows a longitudinal sectional view of a further embodiment.
Figure 12:
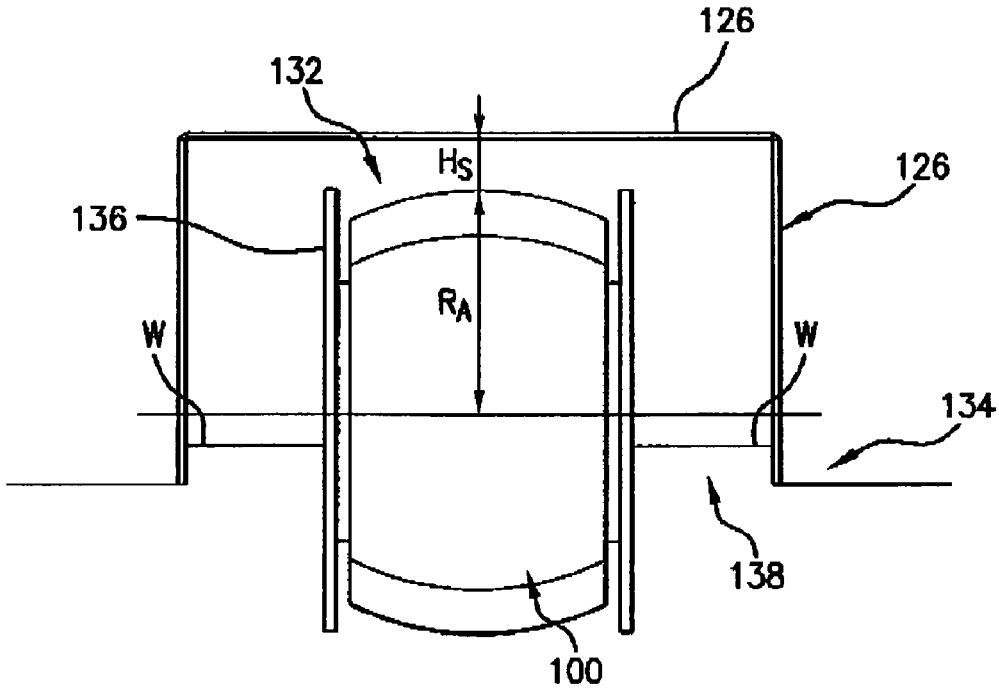
FIG. 12 shows a cross-sectional view of the embodiment shown in FIG. 11.

With the operation of the embodiment the water surrounding the vessel's hull 134 is carried along with the rotation of the propulsion wheel 100 in the main propulsion direction H until on the conclusion of a start-up process a flow circulating with the propulsion wheel 100 is established in the gap 132. The side cheeks 136 stabilise the continuous, separation-free circulating flow in the gap 132. Practical experiments have shown that on reaching the operating point, i.e. after complete elimination of air located above the water surface W in the idle state from the gap 132, additionally water flows through an intervening space 138 between the side surfaces of the propulsion wheel and the side surfaces 116, 118 of the housing, filling it up. The ensuing phenomena cannot at present be fully described theoretically. It has also been found that the intervening space 138 must have a certain volume which is matched to the volume of the gap. The volume of the intervening space 138 is calculated from a base area, which is shown hatched in FIG. 11, multiplied by the width B of the intervening space 138 in the axial direction. In FIG. 12, $R_A$ is the radius of the propulsion wheel 100 measured from its axis of rotation to the highest point of the tooth tip 112. Hs designates the height of the gap 132 between the highest point of the tooth tip 112 of a tooth 102 and the cover 126 in its enclosure region which is constant in the circumferential direction. The lower secant S corresponds to the imaginary extension of the vessel's hull between the parts of the vessel's hull 134 located in front of the gap 132 and behind the gap.

The gap volume is calculated from the gap area in a gap, which where necessary is only constant in sections, and the enclosure section of the gap.

As can be seen in FIG. 12, the base area of the gap is enclosed by the imaginary extension of the inner surfaces of the cheeks 136, i.e. the extension of the outer surfaces of the outer sides of the propulsion wheel 100 and the surface of the cover 126 on one side and the contour of the tooth tip 112 on the other side. The additional volume formed by gusset channels between adjacent tooth faces is not taken into account in the calculation of the gap volume.

The ratio of the volume of the intervening space 138 to the volume of the gap 132 is preferably between 0.75 and 1.25, especially preferably between 0.9 and 1.1.

Figure 13:
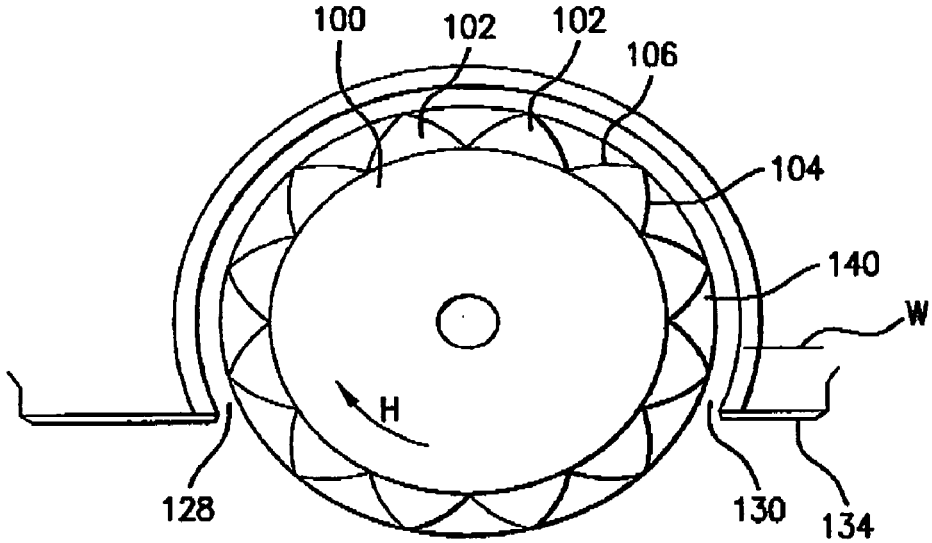
FIG. 13 shows a longitudinal sectional view of a final embodiment.
Figure 14:
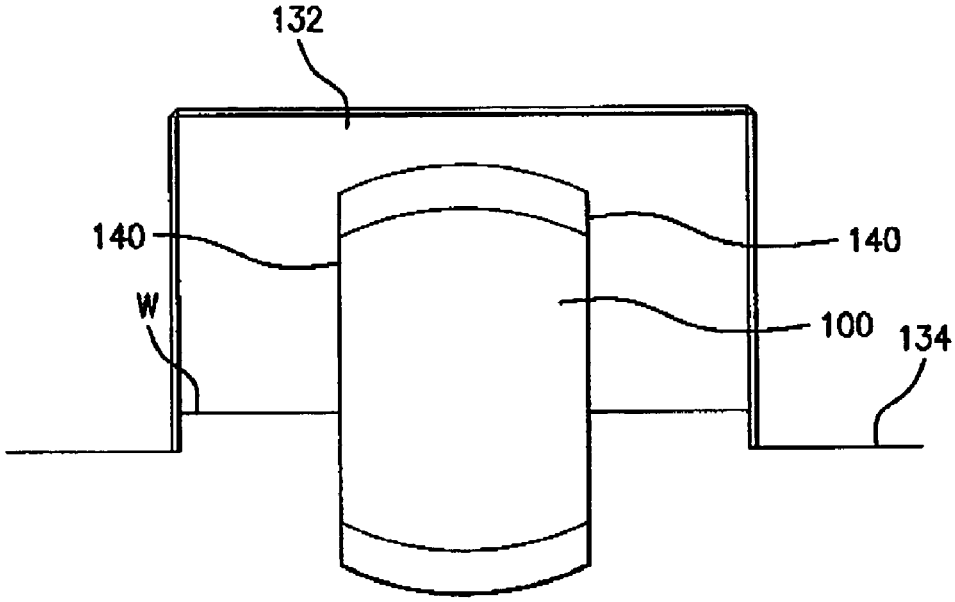
FIG. 14 shows the embodiment shown in FIG. 13 as a cross-sectional view.

With the embodiment illustrated in FIGS. 13 and 14 the propulsion wheel 100 exhibits teeth 102 which are formed symmetrically about a line which also includes the tooth tip 112. The leading face 104 is correspondingly geometrically identically formed like the trailing face 106. The inlet aperture 128 and the outlet aperture 130 are located at the same height in relation to the vessel's hull 134.

The embodiment of a vessel propulsion system illustrated in FIGS. 13 and 14 has no main direction of propulsion but rather provides the same thrust in each of the two directions of rotation of the drive referred to the engine power applied. This type of vessel propulsion system can be used, for example, in bow thrusters or in vessels where the manoeuvrability and tractive power in the forwards and reverse direction is more important than the best possible efficiency when moving fast in a straight line. The embodiment of a vessel propulsion system illustrated in FIGS. 13 and 14 is especially suitable, for example, for installation in a river ferry.

The embodiment illustrated in FIGS. 13 and 14 exhibits no side cheeks, which means that, in the intervening space 138, flowing water can enter in the axial direction into the gusset channels 140 which are formed between adjacent teeth 102 of the propulsion wheel 100. It has been found that with vessel propulsion systems which provide the same thrust power irrespective of the direction the unimpaired access of water flow in the intervening space to the space enclosed between the outer circumferential surface of the propulsion wheel 100 and the cover 126 is of special significance. With regard to a certain guidance of the flow circulating with the propulsion wheel 100, a collar enclosing the circumference of the tooth tips 112 can be provided on both sides of the propulsion wheel 100, the said collar being freely open for axial access to the gusset channels 140 between the teeth 102.

With the embodiment in which the gusset channels communicate axially with the intervening space, the surface shape of the propulsion wheel is not restricted to the spherical shape claimed with the first aspect of this invention. It is therefore also possible to form the propulsion wheel by a wide cylindrical roller with any tooth geometry. In the design of the propulsion wheel it is essential according to the current position of the applicant only that the propulsion wheel exhibits a tooth arrangement on its outer circumferential surface, the said tooth arrangement displacing the surrounding water in order to form a flow circulating in the circumferential direction in the gap. In the sense of the invention, the propulsion wheel can in this case be taken to mean a means of propulsion which is formed by a circulating band. Whereas with the embodiments a propulsion wheel is illustrated arranged in each case on the drive shaft, also a number of propulsion bodies next to one another can be mounted on the drive shaft for the realisation of the vessel propulsion system according to the invention, which with a relatively simple method of construction leads to an increase in the efficiency due to greater amounts of flow for the same power.

LIST OF NUMBERS AND LETTERS REFERENCED

2 Vessel
4 Vessel propulsion system
6 Toothed wheel
8 Cover
10 Axis of rotation
12 Front end
14 Rear end
16 Hull
18 Sidewall
20 Sidewall
22 Drive shaft
24 Bearing
26 Bearing
28 Angular gear
30 Motor
32 Cross brace
34 Hood
36 Lower part
38 Upper part
40 Flange
42 Bounding element
44 Bounding element
46 Tooth
48 Tooth tip
50 Leading edge
52 Trailing edge
54 Gap
56 Sidewall
58 Pan
60 Sidewall
62 Recess
64 Float
66 Bearing
68 Support plate
70 Recess
72 Bellows
74 Bearings for the floats
76 First circumferential section
78 Second circumferential section
80 Thickening
82 Inclination attenuator
D Direction of rotation
S Steering axis
V Direction of propulsion
W Waterline
100 Propulsion wheel
102 Tooth
104 Leading face
106 Trailing face
108 Tooth base
110 Tooth base
112 Tooth tip
114 Drive shaft
116 Side surface
118 Side surface
120 Housing
122 Roller bearing
124 Roller bearing
126 Cover
128 Inlet aperture
130 Outlet aperture
132 Gap
134 Vessel's hull
136 Cheek
138 Intervening space
140 Gusset channels
A Main direction of propulsion
S Secant
H Direction of rotation in main direction of propulsion
W Water surface
$R_A$ Maximum radius of the propulsion wheel
$H_S$ Minimum height of the gap between the propulsion wheel and the cover

The invention claimed is:

1. Vessel propulsion system for propelling a vessel (2) in a given direction of propulsion (V), comprising:

(a) a vessel (2) adapted to float in water, thereby to define a waterline (W);

(b) propulsion means having operable and inoperable conditions, said propulsion means including a propulsion device (6) rotatably connected with said vessel at a location at which the propulsion device is immersed in the water, said propulsion device having an axis of rotation (10) that is generally normal to the direction of propulsion, said propulsion device having a circumferential surface;

(c) a cover (8) partially enclosing said propulsion device and cooperating with said circumferential surface to produce a water conveying flow channel in which water is conveyed continuously with said propulsion device when said propulsion device is in said operable condition, thereby fully removing any air that is included between said cover and said propulsion device when said propulsion device is in said inoperable condition; and (d) a pair of bounding elements (42, 43) bordering the sides of said propulsion device and extending beyond said circumferential surface to a location adjacent said cover.

2. Vessel propulsion system according to claim 1, characterized in that the propulsion device comprises a rotatably driven wheel (6).

3. Vessel propulsion system according to claim 1, characterized in that the propulsion device comprises a rotatably driven revolving belt.

4. Vessel propulsion system according to claim 1, characterized in that the propulsion device (6) exhibits a circumferentially closed circumferential surface.

5. Vessel propulsion system according to claim 1, characterized in that the bounding elements and the cover are arranged stationarily.

6. Vessel propulsion system according to claim 1, characterized in that the bounding elements (42, 44) are connected to the rotating propulsion device (6).

7. Vessel propulsion system according to claim 1, characterized in that the outer circumferential surface of the propulsion device (6) has several teeth (46) arranged one behind the other.

8. Vessel propulsion system according to claim 7, characterized in that each tooth (46) has a leading edge (50) directed radially outwards and a trailing edge (52) extending therefrom, directed radially inwards, and the leading edge (50) has a gradient lower than that of the trailing edge (52).

9. Vessel propulsion system according to claim 8, characterized in that the tooth tip (48) of the teeth (46) is formed as a convex curvature in the axial direction.

10. Vessel propulsion system according to claim 9, characterized in that at least one of the leading (50) and trailing (52) edges of the teeth (46) is formed as a convex curvature in the axial direction.

11. Vessel propulsion system according to claim 10, characterized in that at least one of the leading (50) and trailing (52) edges of the teeth is formed as a convex curvature in the circumferential direction.

12. Vessel propulsion system according to claim 1, characterized in that a rear end (14) of the cover (8) forming the inlet for the flow channel has a curvature directed forwards.

13. Vessel propulsion system according to claim 1, characterized in that the front end (12) of the cover forming the outlet for the flow channel has a curvature directed backwards.

14. Vessel propulsion system according to claim 1, characterized in that the upper edge of the cover (8) is arranged above the waterline (W) of the vessel (2) and at least one of the front and rear ends (12, 14) of the cover (8) extends below the waterline (W).

15. Vessel propulsion system according to claim 1, characterized in that the cover extends with an enclosure angle of between 200° and 270' about the propulsion device (6).

16. Vessel propulsion system according to claim 1, characterized in that between the propulsion device (6) and the cover a minimal gap (54) is formed of 2% to 10% of the diameter of the surrounding propulsion device (6).

17. Vessel propulsion system according to claim 1, characterized in that the propulsion device (6) is, perpendicular to its axis of rotation (10), rotatable about a steering axis (S) and a control device is provided to control the rotation of the propulsion device (6) about the steering axis.

18. Vessel propulsion system according to claim 17, characterized in that the propulsion device (6) together with the cover (8) are arranged on a support plate (68) through which the propulsion device (6) protrudes, whereby the upper surface of the support plate is sealed by a hood (34) and the support plate is accommodated in a pan (58) with an open bottom and such pan is rotatably supported in the vessel hull (16) and the propulsion device (6) protrudes through the pan (58) and a seal (72) is provided between the support plate (68) and the pan (58).

19. Vessel propulsion system according to claim 17, characterized in that the hood (34) forms the cover (8).

20. Vessel propulsion system according to claim 19, characterized in that the support plate (68) is, using at least one in-line inclination attenuator (82), supported on the pan (58) such that it can be pivoted.

21. Vessel propulsion system according to claim 1, characterized in that a gap adjusting device is provided for adjusting the propulsion device relative to the cover.

22. Vessel propulsion system according to claim 1, characterized in that it exhibits an immersion depth adjustment device for adjusting the height of the propulsion device and the cover.

23. Vessel propulsion system according to claim 1, characterized in that a float (64) is provided on the front ends of the propulsion device (6) in each case and such float tapers down preferably in the axial direction of the axis of rotation (10), away from the propulsion device (6).

24. Vessel propulsion system according to claim 23, characterized in that the floats (64) are supported in a freely rotatable manner on the axis of rotation (10) or on the drive shaft (22) of the propulsion device (6).

25. Vessel propulsion system according to claim 24, characterized in that on the radial outer end of the propulsion device (6) a thickening (80) is provided which is connected to the propulsion device (6) and which covers the propulsion device (6) in a mushroom-head shaped manner and which, at least partially, circumferentially protrudes beyond the float (64).

26. Vessel propulsion system with a driven, toothed propulsion wheel, which dips partly into the water, the rotational axis of which essentially extends at right angles to the direction of propulsion of the vessel propulsion system, and with a cover partially circumferentially enclosing the propulsion wheel the said cover being arranged in relation to the propulsion wheel (100) such that during operation of the vessel propulsion system a flow circulating in the rotational direction of the propulsion wheel forms between the circumferential surface of the propulsion wheel (100) and the cover, characterized in that the leading and trailing faces (104, 106) of each of the teeth (102) formed on the propulsion wheel exhibit a spherical, convex surface, the tooth tip of each tooth (102) is curved convexly in the axial direction and the starting point of the radii of curvature of the spherical surfaces and the contour of the tooth tip (112) are located in a plane extending orthogonally to the rotational axis of the toothed wheel, the said plane also including the center point of the propulsion wheel (100) in the axial direction.

27. Vessel propulsion system according to claim 26, characterized in that the spherical surfaces and the tooth tip (112) have approximately the same radius of curvature.

28. Vessel propulsion system according to claim 27, characterized in that the radii of curvature of the spherical surfaces and the tooth tip (112) vary at the most by 20% about a mean formed from the three radii of curvature.

29. Vessel propulsion system according to claim 26, characterized in that the starting point of the radius of curvature of each of the trailing faces (106) is essentially located on a circular shaped envelope area containing the tooth tips (112).

30. Vessel propulsion system according to claim 26, characterized in that the starting point of the radii of curvature of each of the leading faces (104) is located on a circle which is situated concentrically to the rotational axis of the propulsion wheel (100) and between a circular area containing each tooth base (108, 110) and the rotational axis.

31. Vessel propulsion system according to claim 30, characterized in that the radius of the circular area is 0.5 to 0.8 of the distance between the rotational axis and the envelope area containing the tooth base (108, 110).

32. Vessel propulsion system according to claim 26, characterized in that the tooth tip (112) is spaced, with a perpendicular distance of 0.08 to 0.12 of the average mean of the three radii of curvature, from a radial line cutting the rotational axis and the tooth base (108) to the trailing face (106) of the corresponding tooth tip (112).

33. Vessel propulsion system with a driven propulsion wheel (100) having a circumference provided with a plurality of propulsion teeth and which partly dips into the water, the rotational axis of which essentially extends at right angles to the propulsion direction of the vessel propulsion system and is arranged with a cover (126) partly enclosing the propulsion wheel (100) circumferentially and cooperating therewith to define a gap (132) such that with the operation of the vessel propulsion system a flow, circulating in the rotational direction of the propulsion wheel (100), is formed between the circumferential surface of the propulsion wheel (100) and the cover (126), characterized in that gusset channels (140), which are formed between adjacent teeth of the propulsion wheel on its circumferential surface, open axially outwards to an intervening space (138) between the propulsion wheel (100) and the side surfaces (116, 118) of a housing (120) enclosing the propulsion wheel (100) and containing the cover (126).

34. Vessel propulsion system according to claim 33, characterized in that said propulsion wheel teeth include leading and trailing faces (104, 106) that are essentially formed the same geometrically, said gap having inlet and outlet apertures (128, 130) that are located at about the same height.

35. Vessel propulsion system according to claim 33, characterized in that the ratio of the volume of the intervening space (138) to the volume of the gap (132) is between 0.75 and 2.00.

36. Vessel propulsion system according to claim 33, characterized in that the distance between the side surfaces of the propulsion wheel (100) and the side surfaces (116, 118) of the housing corresponds at least to half the axial extension of the propulsion wheel (100).

37. Vessel propulsion system according to claim 33, characterized in that a drive shaft (114) of the propulsion wheel (100) protrudes through the side surfaces (116, 118), which side surfaces carry bearings (12,124) for supporting the drive shaft (114).

38. Vessel propulsion system according to claim 33, characterized in that the cover (126) encloses the propulsion wheel (100) with an enclosure angle of between 200' and 300° and a region of the cover (126), forming the outlet aperture (130) for the flow in the main propulsion direction of the vessel propulsion system, encloses the propulsion wheel (100) so far that the flow is ejected mainly parallel to the propulsion direction, whereas a region of the cover (126) forming the inlet (128) of the hydrodynamic drive for the flow in the main drive direction draws in the flow essentially with a speed extending perpendicular to the propulsion direction into a gap (132) formed between the cover (126) and the circumferential surface of the propulsion wheel (100) and that the propulsion wheel (100) exhibits ring-shaped cheeks (136) protruding beyond the tooth base (108) on both of its face sides.

39. Vessel propulsion system according to claim 38, characterized in that the cheeks (136) extend to about the highest point of the tooth tips (112).

40. Vessel propulsion system according to claim 33, characterized in that the gap (132) in the region of the outlet aperture (130) tapers in the main direction of propulsion.

41. Vessel propulsion system according to claim 33, characterized in that the gap in the region of the inlet aperture (128) is widened funnel-shaped.

42. Vessel propulsion system according to claim 33, characterized in that the gap (132) has a constant gap height over 90% to 95% of the enclosure angle essentially in the circumferential direction.

43. Vessel propulsion system according to claim 33, characterized in that the gap (132) in its section constant in the circumferential direction, measured from the radially outermost point of the tooth tip (112), has a height to the cover (126) of 0.08 to 0.12 of the mean of the three radii of curvature.

* * * * *